US011035107B2

(12) United States Patent
Jungklaus et al.

(10) Patent No.: US 11,035,107 B2
(45) Date of Patent: Jun. 15, 2021

(54) PORTABLE WASH BASIN ASSEMBLY

(71) Applicant: Axia Acquisition Corporation, Stone Mountain, GA (US)

(72) Inventors: Matthew W. Jungklaus, Lawrenceville, GA (US); Timothy J. Beran, Dacula, GA (US); Michael T. Ventura, Palm Beach Gardens, FL (US); Mark S. Wilson, Peachtree City, GA (US); Howard D. Hutchinson, Milton, GA (US)

(73) Assignee: AXIA ACQUISITION CORPORATION, Stone Mountain, GA (US)

( * ) Notice: Subject to any disclaimer, the term of this patent is extended or adjusted under 35 U.S.C. 154(b) by 6 days.

(21) Appl. No.: 16/508,859

(22) Filed: Jul. 11, 2019

(65) Prior Publication Data

US 2020/0048878 A1 Feb. 13, 2020

Related U.S. Application Data

(60) Provisional application No. 62/716,703, filed on Aug. 9, 2018.

(51) Int. Cl.
*E03C 1/04* (2006.01)
*A47K 1/02* (2006.01)
(Continued)

(52) U.S. Cl.
CPC ..... *E03C 1/04* (2013.01); *A47K 1/02* (2013.01); *B08B 3/006* (2013.01); *B08B 3/024* (2013.01);
(Continued)

(58) Field of Classification Search
CPC .... E03C 1/04; A47K 1/02; A47K 1/04; A47K 1/05; B08B 3/006; B08B 2203/0264;
(Continued)

(56) References Cited

U.S. PATENT DOCUMENTS 4,072,157 A 2/1978 Wines, Jr. et al.
5,213,119 A * 5/1993 Kusz ..... B05B 15/555 134/95.3
(Continued)

FOREIGN PATENT DOCUMENTS

GB 2491253 A 11/2012
KR 20030046562 A 6/2003
(Continued)

OTHER PUBLICATIONS

Washmaster Instructions, Mudmaster Inc., published as early as Aug. 8, 2018, www.mudmaster.com, (2 pages).
(Continued)

*Primary Examiner* — Benjamin R Shaw
(74) *Attorney, Agent, or Firm* — Michael Best & Friedrich LLP

(57) ABSTRACT

The invention provides, in one embodiment, a portable wash basin assembly for cleaning a tool. The portable wash basin assembly includes a wash basin having a base and at least one sidewall that extends upward from the base to an upper edge, and a plurality of recesses located at the upper edge of the wash basin. The wash basin is configured to support the tool in a first orientation in which a first portion of the tool can be supported within one of the recesses and a second portion of the tool can be supported upon the base, and a second orientation, in which the tool can be supported within two of the recesses on the wash basin.

15 Claims, 6 Drawing Sheets

(51) Int. Cl.
*B08B 3/00* (2006.01)
*B08B 3/10* (2006.01)
*B08B 3/02* (2006.01)

(52) U.S. Cl.
CPC ..... *B08B 3/10* (2013.01); *B08B 2203/0264* (2013.01)

(58) Field of Classification Search
CPC .. B08B 3/024; B08B 3/10; B08B 9/08; B08B 11/02
USPC ..... 4/625; 134/84, 92
See application file for complete search history.

(56) References Cited

U.S. PATENT DOCUMENTS 5,257,423 A 11/1993 Jacobsen et al.
5,343,574 A 9/1994 Butte
5,465,438 A 11/1995 Allman et al.
5,687,434 A 11/1997 Tagg
5,715,547 A * 2/1998 Becker ..... D06F 1/02 4/619
5,878,925 A 3/1999 Denkins et al.
5,881,404 A * 3/1999 Knight ..... A47K 1/02 4/619
6,173,458 B1 1/2001 Maddux
6,253,394 B1 7/2001 Goyette et al.
6,298,502 B1 10/2001 Brown
6,427,259 B1 8/2002 Cawthon
6,711,757 B2 3/2004 Peck
7,240,379 B2 7/2007 Switzer
7,441,286 B1 10/2008 Taylor Parker
7,707,663 B1 * 5/2010 Crawford ..... A45D 19/10 4/523
D665,955 S 8/2012 DeWall
8,528,126 B2 9/2013 Al-Mahnna
9,649,669 B1 5/2017 DeWall
9,717,371 B2 8/2017 Wade
9,883,774 B2 2/2018 Wade
2002/0050284 A1 * 5/2002 Rosa ..... B08B 3/006 134/111
2002/0152568 A1 10/2002 Dillinger
2003/0019031 A1 1/2003 Mosis
2005/0199267 A1 * 9/2005 Oakes ..... B08B 3/14 134/10
2007/0192953 A1 8/2007 Hughes
2009/0113618 A1 * 5/2009 Slayton ..... E03C 1/18 4/638
2012/0102638 A1 * 5/2012 Al-Mahnna ..... A47K 1/02 4/626
2013/0086742 A1 * 4/2013 Didehvar ..... A47K 1/02 4/631
2013/0212801 A1 * 8/2013 Slayton ..... A47K 1/02 4/643
2014/0137904 A1 * 5/2014 Suarez ..... B08B 3/006 134/109
2014/0174479 A1 * 6/2014 Publ ..... B08B 3/04 134/26
2014/0237716 A1 * 8/2014 Tapadiya ..... A61M 3/0287 4/621
2015/0306638 A1 * 10/2015 Ehman ..... B08B 3/006 4/625
2017/0175369 A1 6/2017 Hanson
2017/0231464 A1 8/2017 Kong et al.
2017/0239691 A1 * 8/2017 Arndt ..... B08B 3/006
2018/0259261 A1 * 9/2018 Kim ..... A47K 1/00
2018/0340282 A1 * 11/2018 Kim ..... D06F 1/04
2019/0125135 A1 * 5/2019 Harding ..... E03C 1/32
2020/0277769 A1 * 9/2020 Chong ..... E03C 1/057
2020/0333042 A1 * 10/2020 Doering ..... B29C 33/3857
2020/0350129 A1 * 11/2020 Yang ..... F21S 10/02

FOREIGN PATENT DOCUMENTS

WO 2011025952 A1 3/2011
WO 2013000486 A2 1/2013

OTHER PUBLICATIONS

International Search Report and Written Opinion for Application No. PCT/US2019/041369 dated Oct. 25, 2019 (13 pages).

* cited by examiner

PORTABLE WASH BASIN ASSEMBLY

CROSS-REFERENCE TO RELATED APPLICATIONS

This application claims priority to U.S. Provisional Patent Application No. 62/716,703 filed on Aug. 9, 2018, the entire content of which is incorporated herein by reference.

FIELD OF THE INVENTION

The present invention relates to wash basins, and more particularly to wash basins that can be used to wash tools, including drywall tools.

BACKGROUND OF THE INVENTION

Drywall tools, such as drywall compound applicators, require frequent washing between uses. While contractors are on a job site, running water may not be available, or a utility sink may not be available for contractors to clean their tools.

SUMMARY OF THE INVENTION

The invention provides, in one aspect, a portable wash basin assembly used for cleaning drywall tools, such as drywall compound applicators, including a basin having multiple recesses or scallops along an upper edge thereof to secure one end of a drywall tool to the basin while the other end is being cleaned.

The invention provides, in one embodiment, a portable wash basin assembly for cleaning a tool. The portable wash basin assembly includes a wash basin having a base and at least one sidewall that extends upward from the base to an upper edge, and a plurality of recesses located at the upper edge of the wash basin. The wash basin is configured to support the tool in a first orientation in which a first portion of the tool can be supported within one of the recesses and a second portion of the tool can be supported upon the base, and a second orientation, in which the tool can be supported within two of the recesses on the wash basin.

The invention provides, in another embodiment, a method of washing a tool with a portable wash basin. A first portion of the tool is secured within a first recess located at an upper edge of the portable wash basin such that a second portion of the tool extends into the wash basin. The second portion of the tool is washed within the wash basin. The second portion of the tool is repositioned from within the wash basin to a second recess located at the upper edge of the portable wash basin.

The invention provides, in yet another embodiment, a portable wash basin assembly for cleaning a tool. The portable wash basin assembly includes a wash basin having a base and at least one sidewall that extends upward from the base to an upper edge. The wash basin is configured to receive a liquid for cleaning the tool. A plurality of legs are coupled to the wash basin and are adjustable between a use position and a non-use position. A drain is located in the basin and configured to direct the liquid within the basin to a location below the basin. The portable wash basin assembly has a first height when the plurality of legs are in the use position and a second height, less than the first height, when the plurality of legs are in the non-use position.

Figure 1:
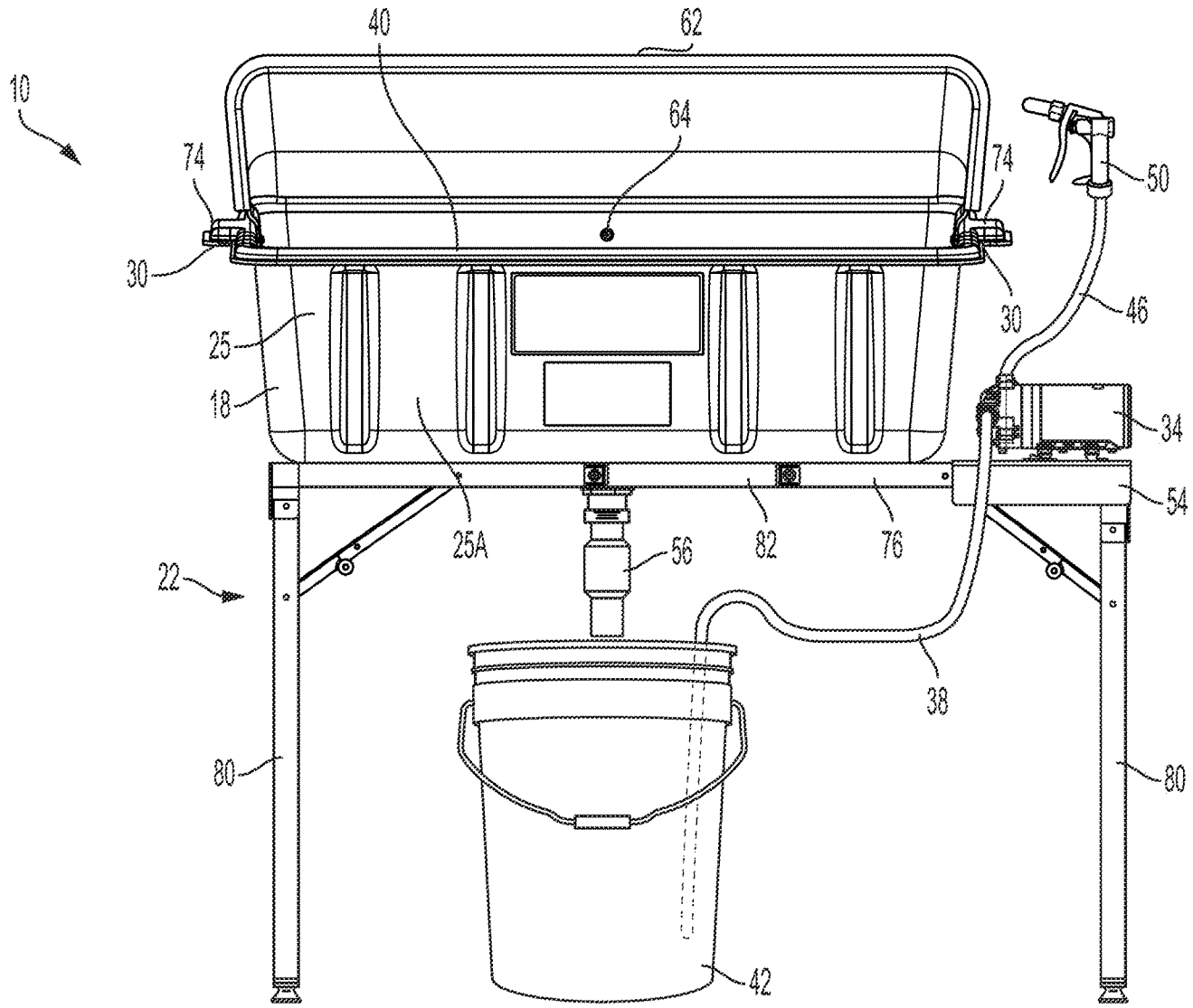
FIG. 1 is a front view of a portable wash basin assembly in accordance with an embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

FIGS. 1-4 illustrate a portable wash basin assembly 10 used for cleaning drywall tools 14, such as drywall compound applicators, or other kinds of tools, on a job site where running water may not be available. The assembly 10 includes a basin 18, a stand 22 supporting the basin 18 at an elevated height, and a drain 26 at the bottom of the basin 18. The stand 22 is formed of a plurality of legs 80 and a frame 76 connected to one another to form a supporting structure for the basin 18, as discussed in greater detail below. The stand 22 also forms a space in which a bucket 42 of water can be placed, as described in greater detail below. Wheels can be implemented on two or four of the legs 80 to assist in moving the assembly 10 through a worksite. In an alternative embodiment of the assembly 10, the stand 22 may be adjustable between a deployed position and a folded position for transport and/or storage.

Figure 2:
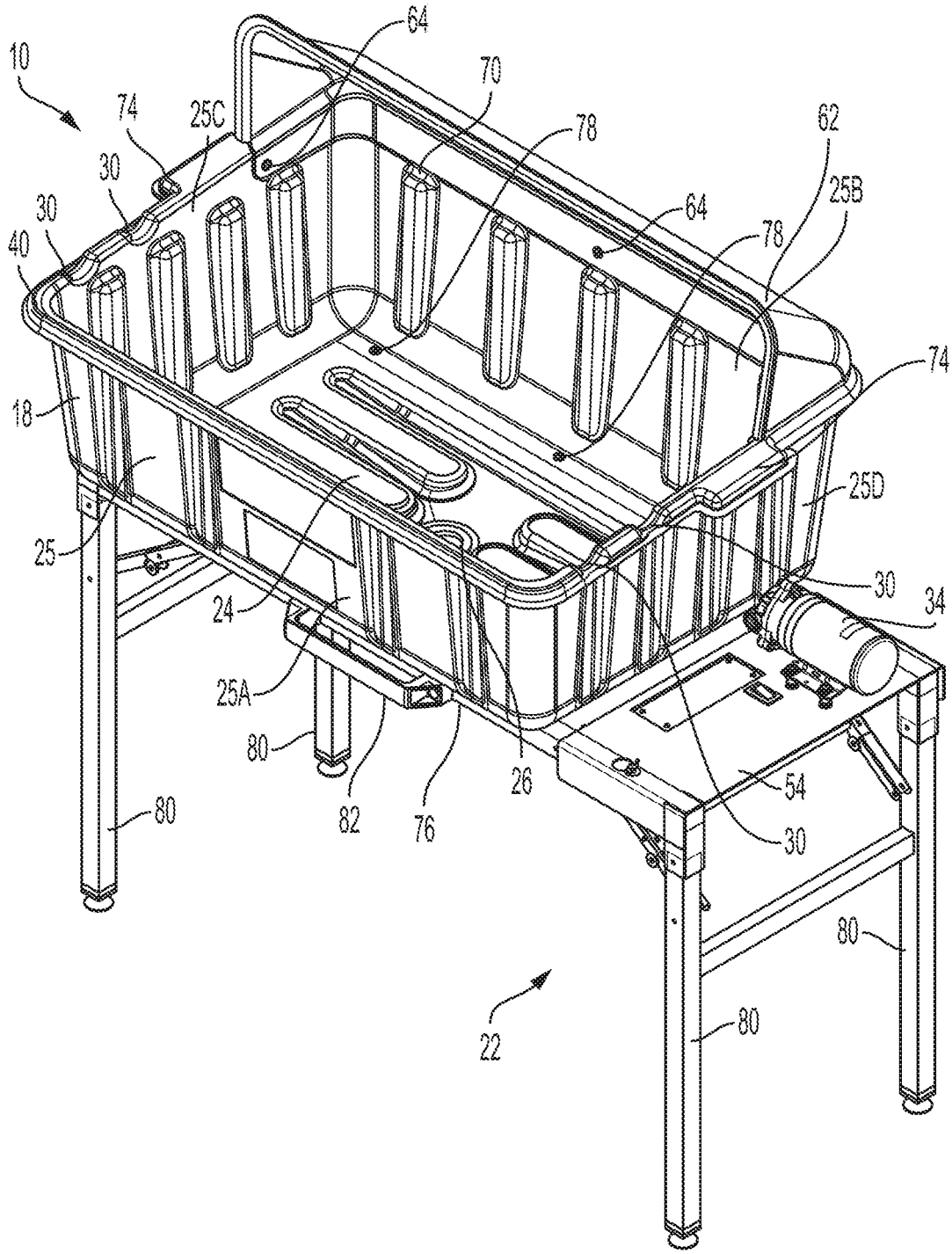
FIG. 2 is a perspective view of the portable wash basin assembly of FIG. 1.
Figure 3:
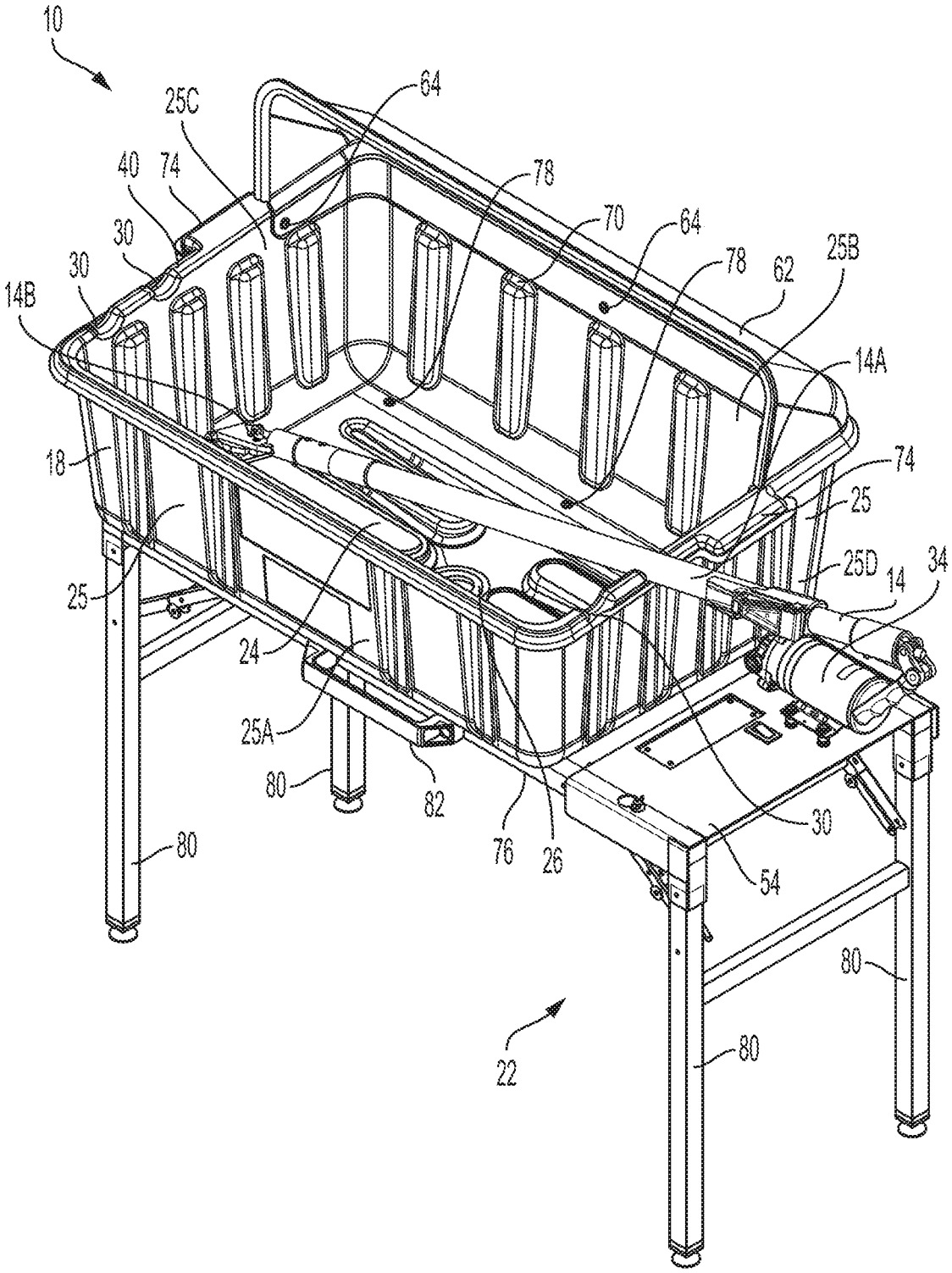
FIG. 3 is a perspective view of the portable wash basin assembly of FIG. 1 with a tool in a first, cleaning position.
Figure 4:
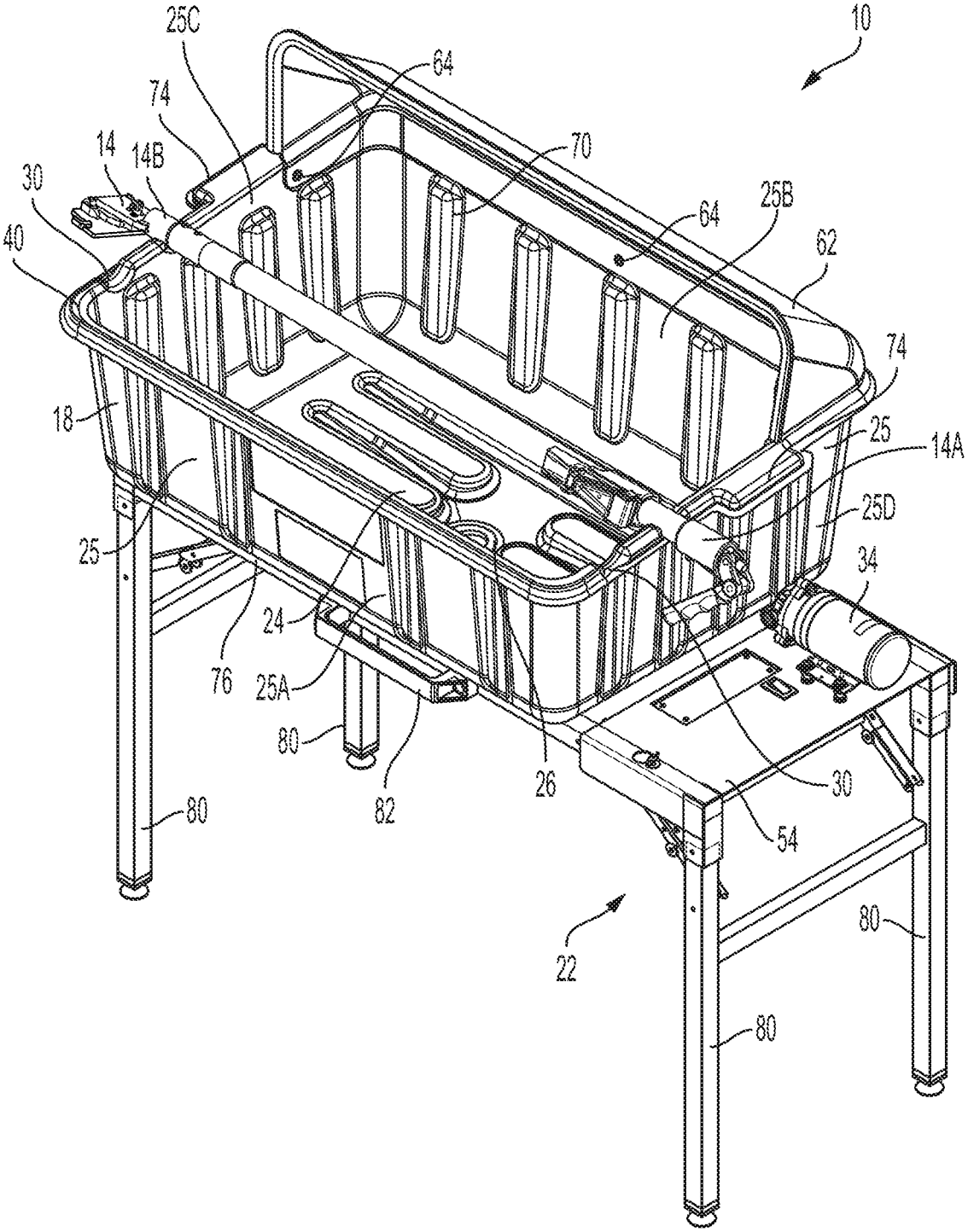
FIG. 4 is a perspective view of the portable wash basin assembly of FIG. 1 with the tool in a second, drying position.

The basin 18 includes a base 24 and four sidewalls 25 that collectively define an interior volume into which water or other cleaning products (e.g., soap, degreaser) and clarifying products may be collected. As such, the basin 18 has a generally rectangular shape. However, in alternative embodiments of the assembly 10, the basin 18 may have a different number of sidewalls to give the basin 18 a different shape. Furthermore, in an alternative embodiment of the assembly 10, the basin 18 may include a single sidewall, thereby giving it a circular or oval shape. As shown in FIGS. 2-4, the four sidewalls 25 include a front sidewall 25A, a rear sidewall 25B opposite the front sidewall 25A, a left sidewall 25C, and a right sidewall 25D opposite the left sidewall 25C. The basin 18 includes multiple scallops or recesses 30 along an upper edge 40 of one or more of the sidewalls 25 to secure one end of a drywall tool 14 to the basin 18 (in a cleaning position) while the other end is being cleaned within the basin 18 (FIG. 3). As shown, the recesses 30 are defined in the upper edge 40 of the basin 18, with the recesses 30 in one sidewall 25 being aligned, respectively, with the recesses 30 in an opposite sidewall 25. Alternatively, recesses 30 may be provided along the upper edge 40 of each of the sidewalls 25A-D. After cleaning, a drywall tool 14 can be supported upon the basin 18 in a drying position by placing opposite ends of the tool 14, respectively, in two opposed recesses 30 in the basin 18 (FIG. 4). In this manner, the tool 14 may be supported above the interior of the basin 18, which may contain residual water therein, or above the ground.

The recesses 30 are depressions in the upper edge 40 having a width sufficiently large to receive the handle of the drywall tool 14 therein and a depth sufficiently large to prohibit the tool 14 from inadvertently falling out of the recess 30 while cleaning the tool 14. The recesses 30 are generally arcuate and are spaced apart from one another by a distance along the upper edge 40 of the basin 18. A portion of the upper edge 40 of the basin 18 extends between the adjacent recesses 30 to separate the recesses 30 from one another. The width of the recesses 30 can vary to hold different tools and can be sized to fit specific tools or can be sized to hold many different tools. The depth of the recesses 30 can be tapered such that tools having larger widths can be used in the same recesses 30 as tools having narrower widths. Further, the recesses 30 can be provided with a snap detent feature (e.g., a resilient finger above the recess 30) to constrain the tool 14 within the recess 30. In the illustrated embodiment of the basin 18, two recesses 30 are formed along the upper edge 40 in each of the left and right sidewalls 25C, 25D, and are located in the front half of the basin 18, nearer the front sidewall 25A than the rear sidewall 25B. As each of the left and right sidewalls 25C, 25D includes a plurality of recesses 30, multiple tools 14 can be secured to the wash basin assembly 10 via the recesses 30 at the same time.

Figure 5:
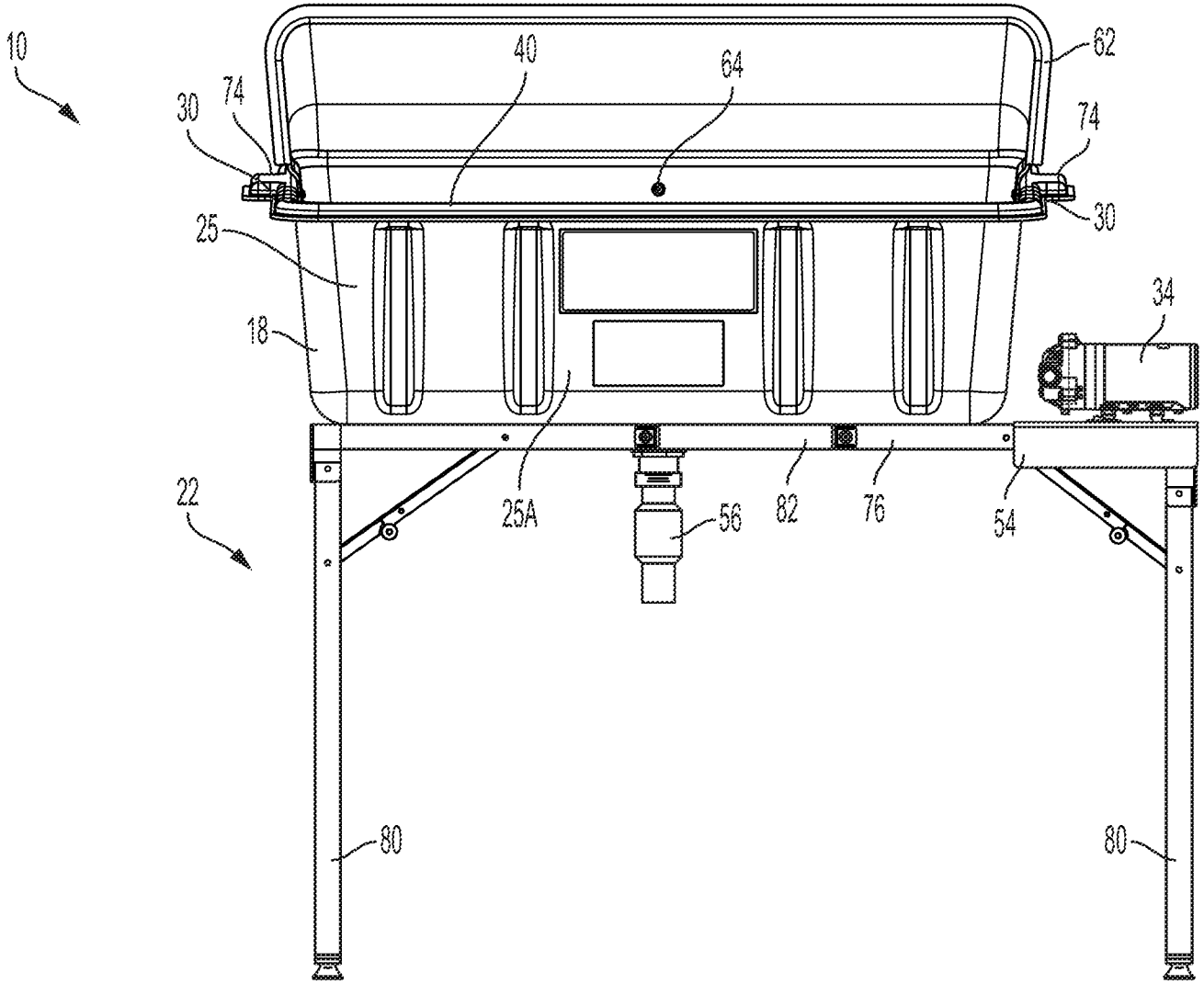
FIG. 5 is a front view of a basin, a frame, and legs of the portable wash basin assembly of FIG. 1 with the legs in a use position.
Figure 6:
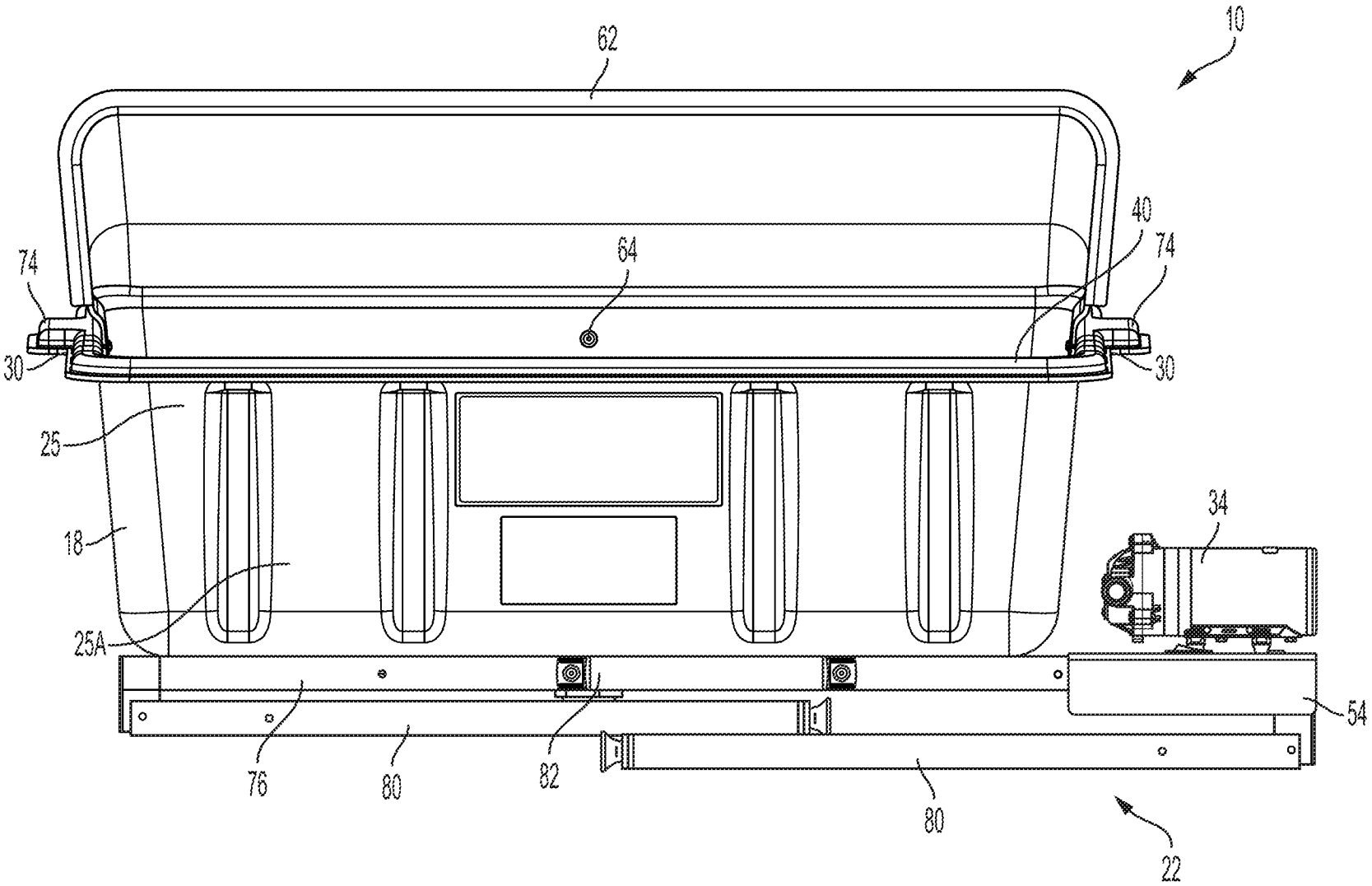
FIG. 6 is a front view of the basin, the frame, and the legs of the portable wash basin assembly of FIG. 1 with the legs in a non-use position.

The basin 18 is mounted to a frame 76. The frame 76 provides support for the basin 18 at a height above the ground. The frame 76 provides a horizontal surface upon which the basin 18 is secured (e.g., via fasteners 78). The frame 76 is supported at a height above the ground by the plurality of legs 80. In other embodiments, the legs 80 may be directly coupled to the basin 18. The plurality of legs 80 extend downward from the frame 76 and support the frame 76 (and therefore also the basin 18) above the ground. As shown in FIGS. 5-6, the legs 80 are adjustable between a use position (FIG. 5) and a non-use position (FIG. 6). In the use position, the legs 80 extend perpendicular to the frame 76 and support the basin 18 at a height such that the bucket 42 can be located below the basin 18. In the non-use position, the legs 80 extend parallel to the frame 76 and the overall height of the wash basin assembly 10 is decreased to assist in transportation and storage. As shown, the legs 80 pivot between the use and the non-use positions. Specifically, two pairs of legs 80 pivot inward together toward the underside of the frame 76 and toward the one another. In other embodiments, the legs 80 may telescope between an extended (use) position and a retracted (non-use) position. In still other embodiments, the legs 80 may be removable such that the use position is defined when the legs 80 are coupled to the remainder of the wash basin assembly 10 (i.e., coupled to the frame 76, coupled to the basin 18) and a non-use position is defined when the legs 80 are removed from the remainder of the wash basin assembly 10.

As shown in FIG. 1, the assembly 10 also includes a pump 34 (e.g., a diaphragm pump). In one embodiment, the pump 34 is powered by an AC power source (e.g., via an electrical cord). In another embodiment, the pump 34 is powered by a DC power source (e.g., a battery or battery pack) onboard the stand 22. The pump 34 has an inlet hose 38 partially submerged in the bucket 42 of water, which is also positioned beneath the drain 26 of the basin 18, and an outlet hose 46 connected to a spray nozzle 50. The hoses 38, 46 can be flexible to increase the ease of use. A flexible inlet hose 38 permits the user flexibility in positioning the bucket 42 beneath the drain 26. A flexible outlet hose 46 provides the mobility necessary to move the nozzle 50 relative to the tool 14 within the basin 18. As shown in FIG. 1, the bucket 42 has a five gallon capacity. Such buckets 42 are commonly found on jobsites and would be readily available for use with the assembly 10 on a jobsite.

As shown, the wash basin 18 further includes a splash guard 62. The splash guard 62 may be molded to fit along the contours of one or more sidewalls 25 of the basin 18 to overlap the sidewalls 25. As shown, the splash guard 62 extends upward from the upper edge 40 of the wash basin 18, extends across the entire rear sidewall 25B and along a rearward portion of the left and right sidewalls 25C, 25D. In this way, the splash guard 62 is located rearward of the recesses 30 so as to not cover the recesses 30. The splash guard 62 may be fastened to the basin 18 (e.g., via threaded fasteners 64) or may otherwise be integrally formed with the basin 18. In yet other embodiments, the splash guard 62 may be slidable (can be inserted vertically) into slits (not shown) within the sidewalls 25, and more specifically into molded protrusions 70 of the wash basin 18. The molded protrusions 70 increase the rigidity of the basin 18 while decreasing the required thickness and weight of the basin 18. The splash guard 62 extends upward above the upper edge 40 of the basin 18, extends at least partially along three of the four sidewalls 25 of the basin 18, and extends at least partially over the interior of the basin 18. The splash guard 62 limits overspray from the spray nozzle 50 over the upper edge 40 of the basin 18.

The basin 18 further includes handles 74 at opposing edges for transporting the basin 18 or the entire assembly 10 to or around a worksite. The handles 74 are integrally molded as a single piece with the basin 18. Alternatively, the handles 74 can be separately attached, for example, via fasteners or adhesive. The frame 76 includes a handle 82 for transporting the basin assembly 10 when the legs 80 are in the non-use position. As shown, the handle 82 is mounted to the frame 76 (e.g., via threaded fasteners) at a location between the pairs of legs 80 on opposite sides of the frame 76.

During use, the pump 34 draws water from the bucket 42 via the inlet hose 38 and discharges pressurized water to the spray nozzle 50 via the outlet hose 46 for cleaning the tools 14 in the basin 18. Water then falls through the drain 26, where it accumulates in the bucket 42 for reuse by the pump 34. The pump 34 is supported on the frame 76 by a bracket 54. In other embodiments, the pump 34 may be coupled to the basin 18 via a bracket, which is removable from and repositionable on the basin 18 to allow different placements on the basin 18. A flexible tube 56 (FIG. 1) can extend downward from the drain 26 toward and/or into the bucket 42 to limit or prevent splashing of water as it falls from the basin 18, through the drain 26, and to the bucket 42. The tube 56 may be removable from the basin 18 to further decrease the overall height of the assembly 10 when the legs 80 are adjusted to the non-use position.

To clean a tool 14, such as a drywall tool, the user places a first portion 14A (e.g., a handle portion) of the tool 14 into a first recess 30 in the wash basin 18 such that a second portion 14B (e.g., a head portion) of the tool 14 extends into the interior volume of the wash basin 18. The tool 14 is secured within the recess 30, as the recess 30 limits movement of the tool 14 at the upper edge 40 of the basin 18 as the user cleans the second portion 14B within the wash basin 18. The pump 34 draws water or other cleaning solution from the bucket 42, as discussed above, for washing the tool 14, and the water is returned to the bucket via the drain 26. A mesh drain cover or other material catch (not shown) may be located in the drain 26 and/or the tube 56 to prevent large material from passing through the drain 26 and into the bucket 42. Once the tool 14 is washed, the user repositions the second portion 14B of the tool 14, removing it from the basin 18 and resting it in a second recess 30, such that the tool 14 is simultaneously resting in two recesses 30 above the basin 18 so that the tool 14 can dry. As the sidewalls 25C, 25D include a plurality of recesses 30, a second tool can be mounted within third and fourth recesses 30 for washing and drying the second tool 14 as the first tool 14 utilizes the first and/or second recesses 30. The process for cleaning the second tool 14 is similar to that of the first tool 14, as described above.

The portable wash basin assembly 10 is able to be assembled quickly and can utilize a common 5-gallon worksite bucket 42 to hold cleaning water. Various components of the assembly 10 can be disassembled and placed within the basin 18 for easy transport to and from worksites.

Although the invention has been described in detail with reference to certain preferred embodiments, variations and modifications exist within the scope and spirit of one or more independent aspects of the invention as described.

What is claimed is:

1. A portable wash basin assembly for cleaning a tool, the portable wash basin assembly comprising:

a wash basin having a base and at least one sidewall that extends upward from the base to an upper edge; and a plurality of recesses located at the upper edge of the wash basin, wherein the wash basin is configured to support the tool in a first orientation in which a first portion of the tool can be supported within one of the recesses and a second portion of the tool can be supported upon the base, and a second orientation, in which the tool can be supported within two of the recesses on the wash basin.

2. The portable wash basin assembly of claim 1, wherein the at least one sidewall includes a first sidewall and a second sidewall, wherein a first recess of the plurality of recesses on the wash basin is located at the first sidewall, and wherein a second recess of the plurality of recesses on the wash basin is located at the second sidewall.

3. The portable wash basin assembly of claim 2, further comprising a third recess located at the first sidewall, wherein a portion of the upper edge of the wash basin extends between the first recess and the third recess.

4. The portable wash basin assembly of claim 3, further comprising a fourth recess located at the second sidewall, wherein a portion of the upper edge of the wash basin extends between the second recess and the fourth recess.

5. The portable wash basin assembly of claim 4, wherein the wash basin is configured to support a second tool in a first orientation in which a first portion of the second tool can be supported within the third recesses and a second portion of the second tool can be supported upon the base, and a second orientation, in which the second tool can be supported within the third and fourth recesses on the wash basin.

6. The portable wash basin assembly of claim 1, wherein the recesses are formed in the upper edge of the wash basin such that the upper edge does not lie in a single plane.

7. The portable wash basin assembly of claim 1, wherein the recesses are formed in the upper edge of the wash basin.

8. The portable wash basin assembly of claim 1, further comprising a splash guard coupled to the wash basin and protruding above the upper edge.

9. The portable wash basin assembly of claim 8, wherein the at least one sidewall includes a first sidewall and a second sidewall, wherein a first recess of the plurality of recesses on the wash basin is located at the first sidewall, wherein a second recess of the plurality of recesses on the wash basin is located at the second sidewall, and wherein the splash guard extends between the first and second sidewalls.

10. The portable wash basin assembly of claim 9, wherein the wash basin includes a third sidewall extending between the first and second sidewalls from which the splash guard extends, and a fourth sidewall extending between the first and second sidewalls, wherein the first and second recesses are closer to the fourth sidewall than the third sidewall.

11. The portable wash basin assembly of claim 1, further comprising a drain located in the wash basin that is configured to direct a liquid within the wash basin to a location below the wash basin for collection in a bucket.

12. The portable wash basin assembly of claim 1, further comprising a pump configured to transfer the collected liquid in the bucket toward the wash basin.

13. The portable wash basin assembly of claim 12, further comprising a nozzle in communication with an outlet of the pump, wherein the nozzle is configured to discharge pressurized liquid from the pump into the wash basin.

14. The portable wash basin assembly of claim 1, further comprising a plurality of legs coupled to the wash basin that are adjustable between a use position and a non-use position.

15. The portable wash basin assembly of claim 14, further comprising a frame upon which the wash basin is supported, wherein the legs are pivotably coupled to the frame between the use position and the non-use position.

* * * * *